US009206794B2

(12) United States Patent
Gridelet

(10) Patent No.: US 9,206,794 B2
(45) Date of Patent: Dec. 8, 2015

(54) MICROFLUIDIC PUMP WITH METAL ELECTRODE HAVING VARIABLE OXIDATION STATE

(75) Inventor: Evelyne Gridelet, Omal (BE)

(73) Assignee: NXP, B.V., Eindhoven (NL)

( * ) Notice: Subject to any disclaimer, the term of this patent is extended or adjusted under 35 U.S.C. 154(b) by 1052 days.

(21) Appl. No.: 12/989,012

(22) PCT Filed: Apr. 22, 2009

(86) PCT No.: PCT/IB2009/051655
§ 371 (c)(1),
(2), (4) Date: Oct. 21, 2010

(87) PCT Pub. No.: WO2009/133499
PCT Pub. Date: Nov. 5, 2009

(65) Prior Publication Data

US 2011/0033315 A1 Feb. 10, 2011

(30) Foreign Application Priority Data

Apr. 28, 2008 (EP) ..... 08103750

(51) Int. Cl.
*F04B 19/00* (2006.01)
*B01L 3/00* (2006.01)

(52) U.S. Cl.
CPC ..... *F04B 19/006* (2013.01); *B01L 3/50273* (2013.01); *B01L 2300/0645* (2013.01); *B01L 2400/0421* (2013.01); *B01L 2400/0427* (2013.01); *Y10T 29/49002* (2015.01)

(58) Field of Classification Search
CPC ..... F04B 19/006; B01L 2400/0421; B01L 2400/0427; B01L 2300/0645; B01L 3/50273
USPC ..... 417/48, 53; 29/888.02; 204/450, 462, 204/600, 672
See application file for complete search history.

(56) References Cited

U.S. PATENT DOCUMENTS

| | | | | |
|---|---|---|---|---|
| 6,565,727 | B1 | 5/2003 | Shenderov | |
| 6,790,011 | B1 * | 9/2004 | Le Pesant et al. | 417/48 |
| 6,911,132 | B2 | 6/2005 | Pamula et al. | |
| 7,117,807 | B2 | 10/2006 | Bohn et al. | |
| 2003/0205632 | A1 * | 11/2003 | Kim et al. | 239/690 |
| 2006/0194331 | A1 * | 8/2006 | Pamula et al. | 436/150 |
| 2007/0023292 | A1 | 2/2007 | Kim et al. | |

(Continued)

FOREIGN PATENT DOCUMENTS

| | | | |
|---|---|---|---|
| FR | 2 848 125 | A1 | 6/2004 |
| JP | 48100522 | A * | 12/1974 |
| WO | 02/07503 | A | 1/2002 |

(Continued)

OTHER PUBLICATIONS

English Abstract of KR20000048131A dated Jul. 25, 2000.*

(Continued)

*Primary Examiner* — Devon Kramer
*Assistant Examiner* — Nathan Zollinger

(57) ABSTRACT

A microfluidic pump comprises a plurality of metal electrodes (10) which oxidise in air, a liquid droplet (14) to be moved by the pump, which is in contact with a least one metal electrode, and a controller for controlling the oxidation state of the metal electrodes in order to vary the electrode wettability. This arrangement enables full integration with a semiconductor device, and with low drive voltages.

20 Claims, 4 Drawing Sheets

(56) References Cited

U.S. PATENT DOCUMENTS

| | | | | |
|---|---|---|---|---|
| 2007/0037294 | A1 | 2/2007 | Pamula et al. | |
| 2008/0142376 | A1 * | 6/2008 | Fouillet et al. | 205/775 |

FOREIGN PATENT DOCUMENTS

| | | | |
|---|---|---|---|
| WO | 2005053836 | A1 | 6/2005 |
| WO | 2006/086620 | A2 | 8/2006 |
| WO | 2006134307 | A1 | 12/2006 |

OTHER PUBLICATIONS

Chen, Ting-Hsuan, "A wettability switchable surface by microscale surface morphology change", J. Micromech. Microeng., vol. 17, No. 3, pp. 489-495 (2007).

Hong, Kwang T., et al; "Effects of Oxidation and Surface-Roughness on Contact Angle"; Experimental Thermal and Fluid Science; pp. 279-285; (1994).

Sondag-Huethorst, J. A. M., et al; "Potential-Dependent Wetting of Electroactive Ferrocene-Terminated Alkanethiolate Monolayers on Gold"; Langmuir J1994, 10; pp. 4380-4387 (Nov. 1994).

Shibuichi, S., et al; "Super Water-and Oil-Repleelent Surfaces Resulting From Fractal Structure"; Journal of Colloid and Interface Science, vol. 208; pp. 287-294; (1998).

Cho, Kilwon., et al; "Effect of the Microstructure of Copper Oxide on the Adhesion Behavior of Epoxy/Copper Leadframe Joints"; J. Adhesion Sci. Technol, vol. 14, No. 11; pp. 1333-1353 (2000).

Pollack, Michael G., et al; "Electrowetting-Based Actuation of Liquid Droplets for Microfluidic Application"; Applied Physics Letters, vol. 77, No. 11; 2 pages (Sep. 11, 2000).

Lee, J., et al; "Electrowetting and Electrowetting-On-Dielectric for Microscale Liquid Handling"; Sensors and Actuators a 95; pp. 259-268; (2002).

Mugele, F., et al; "Electrowetting From Basics to Applications"; Institute of Physics Publishing; Journal of Physics: Condensed Matter 17; pp. R705-R774; (Jul. 20, 2005).

Moon, Ilju, et al; "Using EWOD (Electro Wetting on Dielectric) Actuation in a Micro Conveyor System"; Sensors and Actuators a Physical; A 130-131; pp. 537-544; (2006).

Squires, Todd M., et al; "Microfluidics: Fluid Physics at the Nanoliter Scale"; Reviews of Modern Physics, vol. 77; (Jul. 2005).

International Search Report for Application PCT/IB2009/051655 (Apr. 22, 2009).

* cited by examiner

MICROFLUIDIC PUMP WITH METAL ELECTRODE HAVING VARIABLE OXIDATION STATE

The invention relates to microfluidic pumps.

Microfluidic pumping is used for moving very small volumes of liquid, typically for volumes of a few ml down to much smaller volumes such as a few attolitres (al). Such pumps have applications in chemical processing, ink technology, micro and nano-technologies, lab-on-chip technologies, biotechnology and electronics. For example, ISFETs (Ion Sensitive Field Effect Transistors) can use microfluidic pumping to provide the fluid under test to the gate electrode region of the ISFET.

For example, a microfluidic pump can be used in a lab-on-chip or a biosensor system to move the liquid from one place to another in the system.

Many different microfluidic pumps have been proposed which operate based on the principle of electrowetting.

A liquid that touches a surface will spread along this surface by an amount which depends on its wettability on this surface. This effect is shown in FIG. 1, which shows how a liquid droplet will adhere to a surface for two different wettability conditions. The wettability is higher in FIG. 1(*a*) than in FIG. 1(*b*).

This effect can be used to make a liquid move along a surface: the liquid tends to move to the place of higher wettability. In electrowetting systems, when applying a voltage to the surface, an electric double-layer builds up at the interface between the solid surface and the liquid, consisting of charges of opposite signs on both sides. Because these charges attract each other, the wettability of the surface increases. Therefore, the motion of a droplet on a row of electrodes can be controlled by changing the potential applied to the electrodes.

Typically, a dielectric layer separates the electrode metal from the liquid in order to prevent electrolysis.

A drawback of such known systems based on electrowetting are that the voltage required is high (for example 40V-80V), in particular with reference to voltages which are compatible with standard IC technologies. This makes it impossible to integrate in a single device the pump and the IC to control the pump A system using electronic components and liquid pumping should ideally be integrated, so that state-of-the-art integrated circuits can be manufactured in the same wafer as the microfluidic system that includes pumps, canals etc. However, most microfluidic systems cannot be integrated in a state-of-the-art standard IC process, being too large or using technologies that are not compatible with the IC fabrication.

According to the invention, there is provided a microfluidic pump comprising:

a plurality of metal electrodes which oxidise in air;

a liquid droplet to be moved by the pump, which is in contact with a least one metal electrode; and means for controlling the oxidation state of the metal electrodes in order to vary the electrode wettability.

The invention takes advantage of two well-known material properties and combines them to create an integrated system designed to control the motion of a liquid on a very small scale. These properties are (i) a droplet of liquid on top of an inhomogeneous surface tends to move to the place of higher wettability, and (ii) the wettability of some metals is dependent on the level of oxidation.

Preferably, the pump further comprises a substrate; a dielectric layer formed over the substrate; and a plurality of wells formed in the dielectric, each well containing one of the metal electrodes which oxidise in air. The liquid droplet is then provided over the wells and in contact with the metal electrode of at least one well.

The metal electrodes can be arranged simply as a line of electrodes, and these can have the smallest sizes possible with the semiconductor technology to be used. Thus, full integration with a semiconductor device is possible. This enables integrated use of microfluidic pumps with biosensors and ISFETs, where very large arrays of very small electrodes are needed.

The electrodes comprise oxidised metal. During the operation of the device, a droplet of liquid is deposited on top of an electrode. Then, the electrode is reduced (i.e. changed to a lower oxidation state) in order to change the wettability, to cause movement of the droplet. For example, by reducing the wettability, the droplet will move away from the electrode.

Compared to conventional electrowetting systems, the system of the invention allows smaller devices, requires much lower potentials and can use non-charged liquids.

The pump preferably further comprises a counter electrode, wherein the liquid droplet is in contact with the counter electrode. The counter electrode can run alongside the metal electrodes or it can be formed at the side wall of a channel, with the metal electrodes at the base of the channel. The counter electrode can be formed from the same metal as the metal electrodes. A single shared counter electrode can be used, or else a series of individual electrodes can be provided.

The means for controlling the oxidation state of the metal electrodes can comprise a circuit for applying a negative potential to a metal electrode with respect to the counter electrode. The means for controlling can thus simply comprises a voltage driver circuit.

The substrate can include transistors or other circuitry, for example to actuate and control the pump. Sensors, biosensors, MEMs or other devices can be included in the same substrate.

The liquid droplet is preferably electrically conductive. For example, the liquid can comprise water, preferably with additional ions to increase the conductivity. The liquid may also contain chemical species like ferricyanide or ferrocyanide that can reduce or oxidize at an electrode without modifying the electrode material. The metal preferably comprises a metal with a wettability that is a function of the level of oxidation. For example, the metal can comprise copper or aluminium. In one preferred example, copper electrodes are used with water droplets; the wettability of copper oxide is higher than the wettability of copper for water.

The invention also provides a method of fabricating a microfluidic pump, comprising:

forming a dielectric layer over a substrate;

forming a plurality of wells in the dielectric layer;

at least partially filling each well with a metal electrode which oxidises in air;

providing a liquid droplet, to be moved by the pump, over the wells and in contact with the metal electrode of at least one well.

Forming a plurality wells can further comprise forming a channel, and at least partially filling each well with a metal electrode can further comprise forming a common electrode in the channel.

The invention also provides a method of controlling a microfluidic pump comprising:

controlling the oxidation state of a plurality of metal electrodes, at least one of which is in contact with a liquid droplet, thereby to vary the electrode wettability and control the movement of the liquid droplet between the metal electrodes.

Examples of the invention will now be described in detail with reference to the accompanying drawings, in which.

The invention provides a microfluidic pump the oxidation state of metal electrodes is controlled in order to vary the electrode wettability, and thereby cause movement of a liquid droplet in contact with the metal electrodes.

A common metal used in the semiconductor industry is copper. Copper has three states of oxidation: Cu, $Cu^{+}$, $Cu^{2+}$. A piece of bare copper exposed to the normal atmosphere transforms itself its surface into copper oxide, $Cu_2O$ or CuO. The wettability of the copper oxides is known to be higher than the wettability to non-oxidized copper. The same property applies to aluminium. The invention makes use of this property to provide movement of a liquid by changing the wettability of oxidised metal electrodes, with direct contact between the metal electrode and the liquid droplet.

Figure 1:
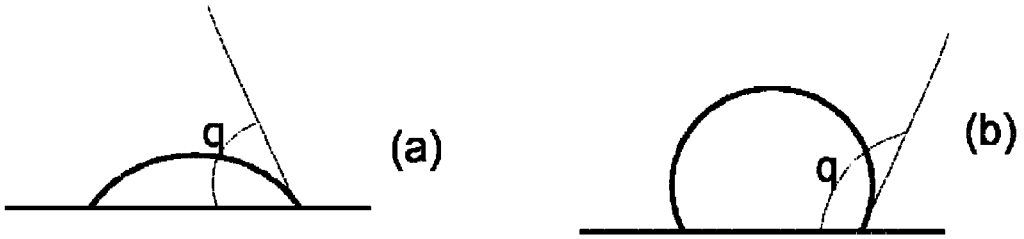
FIG. 1 shows how wettability of a surface influences droplet formation on the surface.
Figure 2:
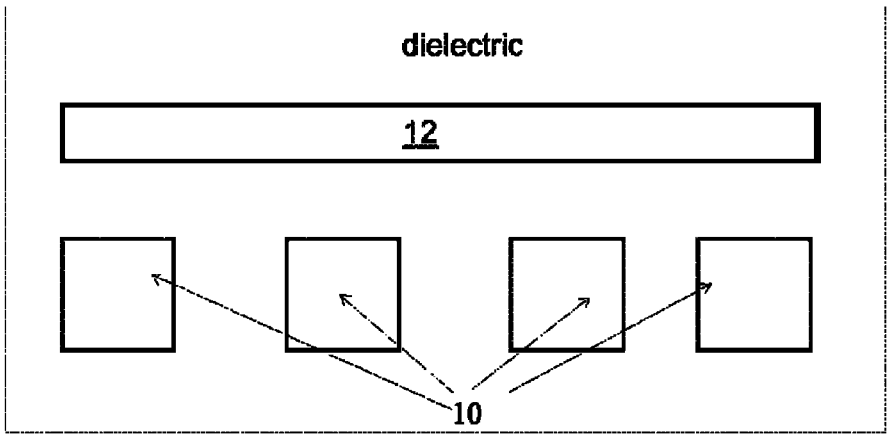
FIG. 2 shows in plan view an example of pump of the invention.
Figure 3:
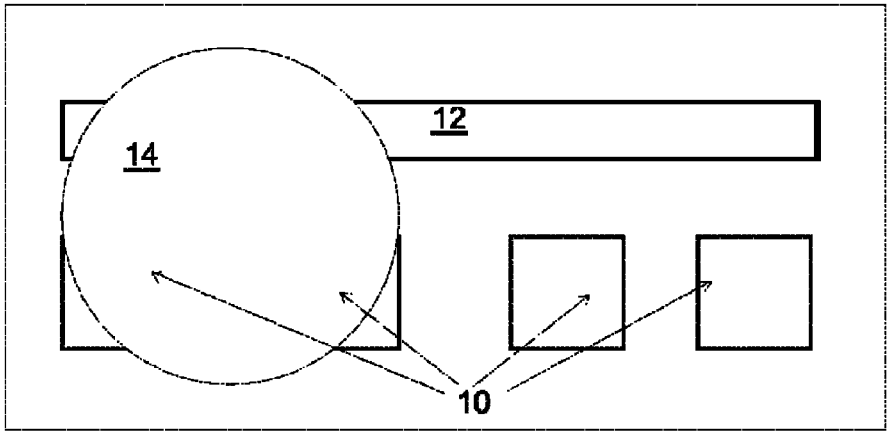
FIG. 3 shows in plan view the pump of FIG. 2 with a droplet in place.

As shown in FIG. 2, an example of device of the invention comprises a row of identical copper electrodes 10 and a counter electrode 12. These electrodes are all defined in a dielectric layer. A droplet of liquid 14, water for example, is deposited on one or several of the electrodes in a way that the liquid also touches the counter electrode 12. This is shown in FIG. 3.

Figure 4:
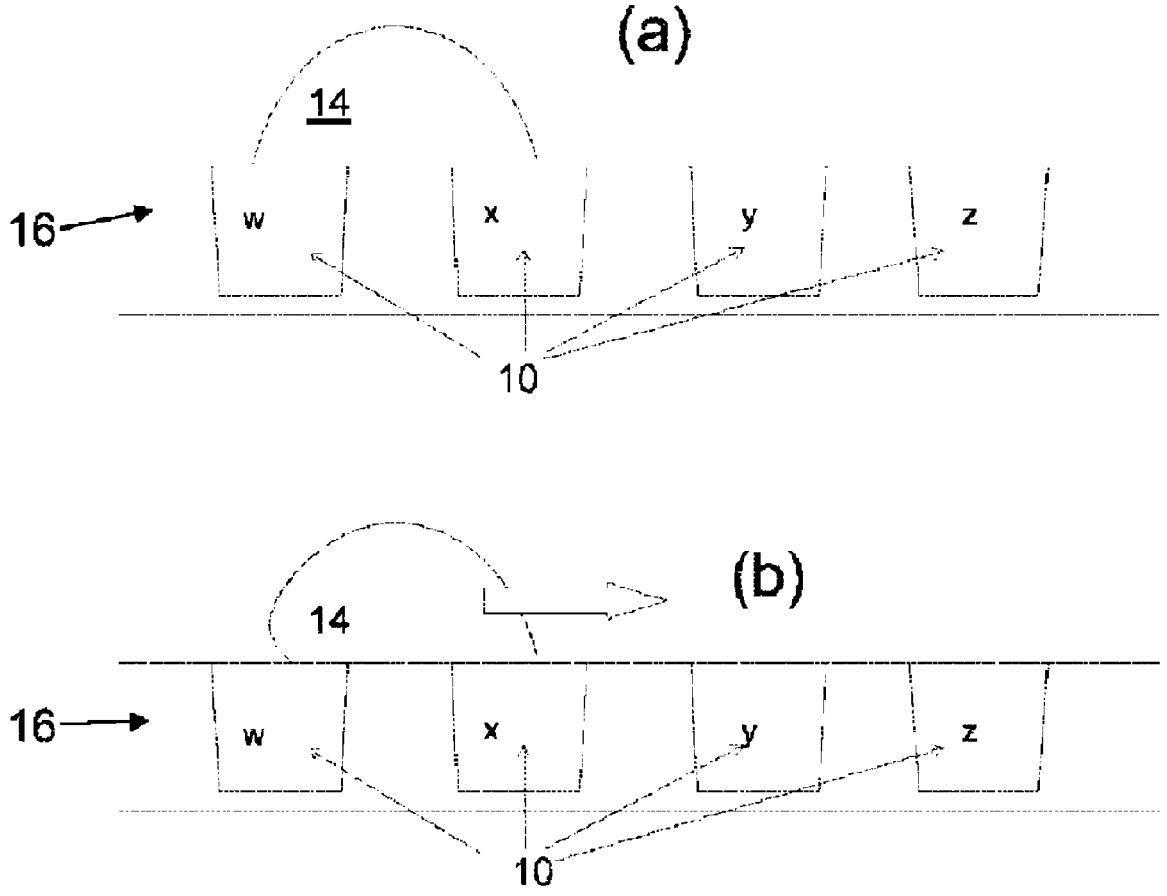
FIG. 4 is used to explain how the pump of FIGS. 3 and 4 can be controlled to provide movement of the liquid droplet.

FIG. 4 shows how the device operates, and shows four electrodes w, x, y and z formed in a dielectric layer 16. The counter electrode is not shown for clarity. In FIG. 4(*a*) all the electrodes are oxidized. In FIG. 4(*b*), the electrode w is reduced and its wettability decreases.

In FIG. 4(*a*) the copper electrodes are all at a potential where the copper is oxidized. The wettability for all electrodes is good and the droplet spreads (wets) well over the electrodes. When a negative potential is applied to the electrode w below the droplet, it reduces and thus decreases its wettability. This change of wettability induces a motion of the droplet in the direction towards the region where the copper electrodes are still oxidized. This droplet motion is shown in FIG. 4(*b*).

This droplet motion is not induced by the normal electrowetting process, which an electric field induced effect, through a dielectric layer. Instead, the process relies on the change in oxidation state of the metal electrodes, with direct contact between the metal electrodes and the liquid. This enables lower drive voltages to be used.

The voltage can be between a few mV and several volts, for example preferably be around 0.5V. The electrodes can have a lateral dimension from 50 nm, or even lower, to 1 cm, preferably around 500 nm. The volume of a droplet can be between a zl (zeptolitre) and a ml, preferably around an al (attolitre).

The use of metal electrodes enables fabrication using standard fabrication processes, in particular CMOS processes in a standard CMOS fabrication plant. For example, when using copper electrodes, very small dimensions are possible.

Figure 5:
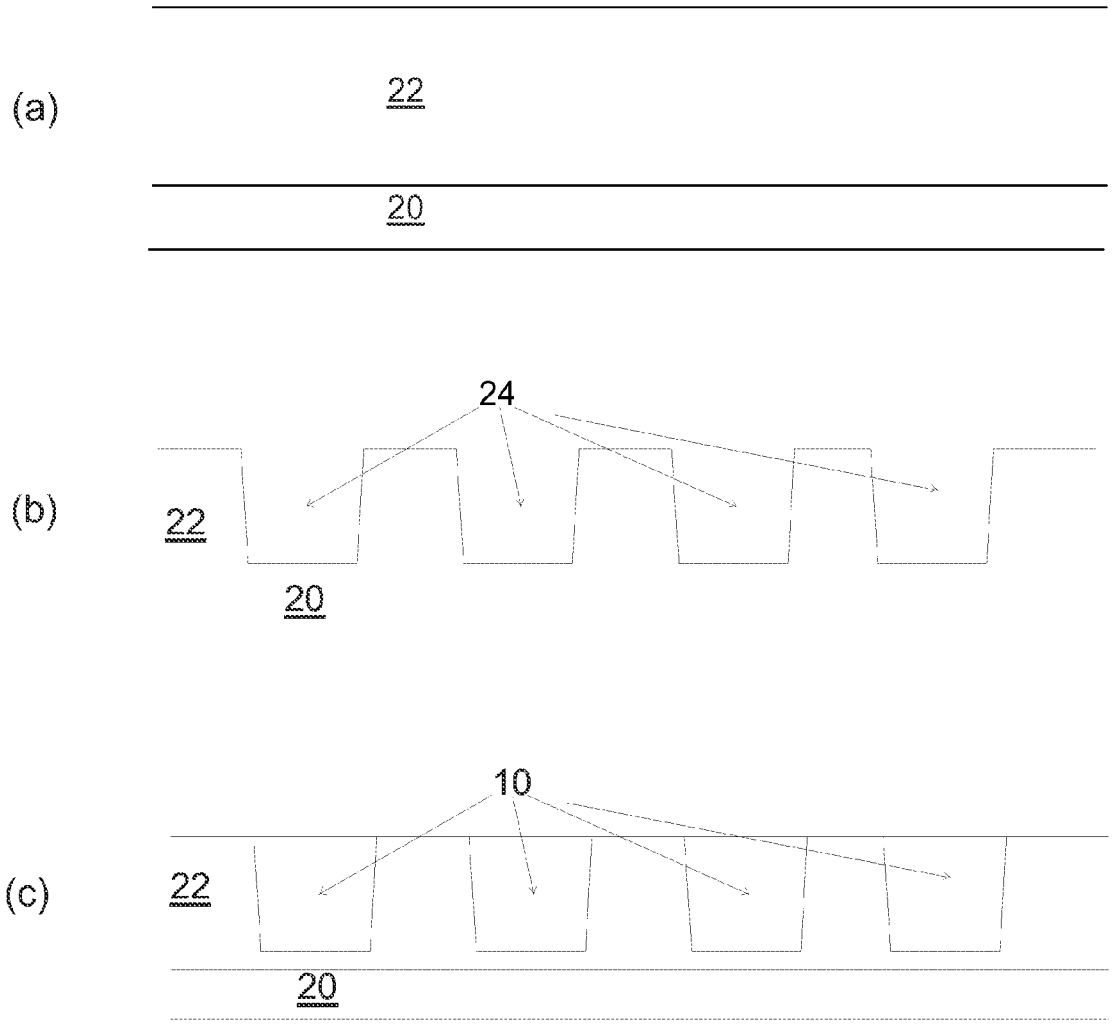
FIG. 5 shows how the device of FIGS. 3 and 4 is manufactured.

The essential fabrication steps of the present embodiment are depicted in FIG. 5.

FIG. 5(*a*) shows the starting point of a substrate 20, which can include an integrated circuit. A layer of an insulating material, for example $SiO_2$, is deposited to form a dielectric layer 22 to provide separation between the electrodes.

As shown in FIG. 5(*b*), holes 24 are etched where the electrodes will be formed. In a preferred embodiment, a line for the counter electrode is etched at the same time.

As shown in FIG. 5(*c*), the holes are filled with copper to define the electrodes 10. An adhesion layer, for example made of Ta or TaN, between the copper and $SiO_2$ layer may also be provided. The copper electrodes can be in electrical contact with the electronics in the integrated circuit.

In the design of this embodiment, the counter electrode is also made of copper. This means that the counter electrode may oxidize every time an electrode reduces. A current has to flow in the liquid, which means that one electrode oxidizes and the other one reduces, or a molecule in the liquid has to reduce.

To be sure that the change in the wettability of the counter electrode does not prevent the droplet motion, the surface of the counter electrode that touches the droplet may be smaller in area than the surface of the electrode that touches the droplet.

Figure 6:
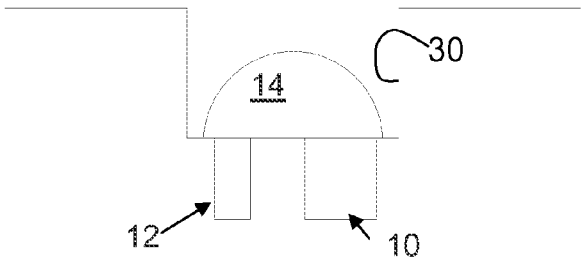
FIG. 6 shows a first alternative arrangement.

In the embodiment shown in FIG. 6, both electrodes are at the bottom of a channel 30, and this can be arranged to ensure the desired droplet contact areas. Alternatively, the counter electrode can be formed in a different material or it can be coated. For example, a coating of Ag/AgCl may be used to provide a more stable potential. A self-assembled monolayer may instead be provided.

Figure 7:
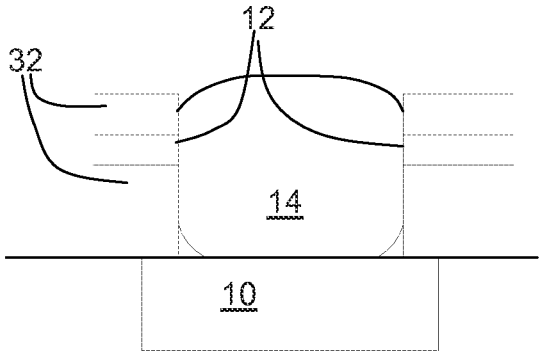
FIG. 7 shows a second alternative arrangement.

For example, in FIG. 7, the counter electrode may be made from a separate layer in the structure, for example formed from TaN. In FIG. 7, the control electrodes are at the base of a channel, and the counter electrode is defined in the channel side wall, sandwiched between insulating dielectric layers 32.

The operation of the device will now be explained in greater detail. The copper electrodes spontaneously oxidize in the atmosphere, which thus naturally places them in a state of good wettability for water. The droplet of water contacts two of the drive electrodes, for example electrodes w and x as shown in FIG. 4(*a*), as well as touching the counter electrode. A negative potential is then applied with respect to the counter electrode to one electrode, electrode w in this example. Its wettability decreases and the contact angle of the droplet increases as shown in FIG. 4(*b*).

The increase in the contact angle induces a motion in the direction of a higher wettability, i.e. in the direction of electrode x.

The droplet then moves to a position in which it is one top of electrodes x and y. A negative potential can then be applied to electrode x to move the droplet towards electrodes y and z.

The device can thus be operated by a sequence of negative electrode voltage in order to implement the desired pumping. The sequential drive can be implemented by a flip-flop circuit implemented in the integrated circuit, in order to give a continuous shift in the potential that reduces the electrodes in turn.

It should be understood that the invention is not limited to this fabrication process or electrode configuration. A number of possible variations are discussed below.

Figure 8:
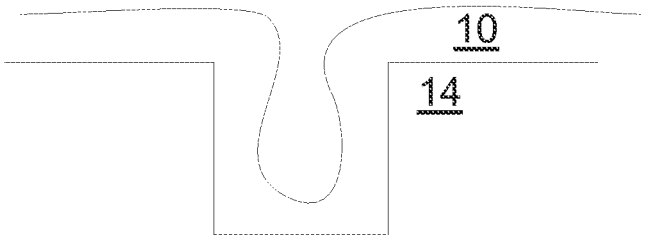
FIG. 8 shows a third alternative arrangement.

The counter electrode can be integrated as part of the IC as described above, or it can be external. The drive electrodes can be horizontal, vertical, or have any suitable geometry. Instead of filling a channel to define an electrode, the electrodes may be defined in a copper line by partial metallization as shown in FIG. 8. This partial metallization forms a channel which follows the channel shape of the underlying dielectric layer.

A number of electrode shapes are possible instead of the square electrodes shown in the drawings. The electrodes may for example have a zigzag shape, and this can improve the droplet motion. Equal spacing of the electrodes is not essential. The drive electrodes can define a region which is used to simply the placing of the liquid droplet. For example, the drive electrodes may have a decreasing size to enable the droplet to be deposited by hand the droplet on a large electrode, with the driver used to route the droplet to a very precise place on a small electrode at the end. A gradient of wettability, derived from a gradient of static potentials, may also be defined. This can then give a permanent path along which droplets will travel.

Many different designs are possible for the counter electrode. For example, a line of counter electrodes may be provided between two lines of electrodes. All drive electrodes may have a common counter electrode, or each drive electrode may have its own counter electrode. The counter electrode may be made from the same material as the drive electrode or from a different material.

The roughness of a surface is also known to change the wettability. In the present invention, roughness may also be used to tune the wettability.

The surface of the dielectric layer between the drive electrodes can be hydrophilic or hydrophobic.

The wettability may also be changed only in the direction of an increase caused by a non-reversible oxidation, as is the case for TaN. TaN is usual in the semiconductor industry but gives an oxide that can only be reduced with difficulty. In this case, the pump can be used only once.

Water is only one example of possible liquid, and many other liquids or solutions will be possible.

In the example above, the droplet is moved by decreasing the wettability behind it. Alternatively, the droplet can be pulled by increasing the wettability before it. These two drive mechanisms can also be combined.

The system of the invention does not require any special measures to be taken to provide lyophobicity or lyophilicity.

Various other modifications will be apparent to those skilled in the art.

The invention claimed is:

1. A microfluidic pump comprising:

a surface having a plurality of metal electrodes which oxidise in air and a counter electrode;

wherein the oxidation state of the metal electrodes is controlled by changing the chemical nature of metal electrodes' surface in order to vary electrode wettability, wherein the counter electrode and the metal electrodes are spaced apart such that when a liquid droplet is in direct contact with at least one metal electrode of the plurality of metal electrodes and the counter electrode, the liquid droplet is moved on the surface by the microfluidic pump, wherein a surface of the counter electrode that is in direct contact with the liquid droplet is smaller in area than a surface of the at least one metal electrode of the plurality of metal electrodes that is in direct contact with the liquid droplet such that change in the wettablity of the counter electrode does not prevent the liquid droplet motion, and wherein the counter electrode and the metal electrodes are arranged in a parallel coplanar fashion on the surface of the microfluidic pump.

2. The microfluidic pump as claimed in claim 1, comprising:

a substrate;

a dielectric layer formed over the substrate; and a plurality of wells formed in the dielectric layer, each well containing one of the plurality of metal electrodes, wherein when the liquid droplet is in direct contact with the at least one metal electrode of the plurality of metal electrodes and the counter electrode, the liquid droplet is provided over at least one of the wells.

3. The microfluidic pump as claimed in claim 1, wherein the counter electrode is formed from the same metal as the metal electrodes.

4. The microfluidic pump as claimed in claim 1, wherein the liquid droplet is electrically conductive.

5. The microfluidic pump as claimed in claim 1, wherein the microfluidic pump comprises a circuit for applying a negative potential to the at least one metal electrode of the plurality of metal electrodes with respect to the counter electrode for controlling the oxidation state of the metal electrodes.

6. The microfluidic pump as claimed in claim 1, wherein the liquid comprises water.

7. The microfluidic pump as claimed in claim 1, wherein the liquid comprises water with either additional ions to increase the conductivity or with additional chemical species that can change their oxidation state at an electrode without changing the electrode material.

8. The microfluidic pump as claimed in claim 1, wherein the metal of the plurality of metal electrodes comprises a metal with a wettability that is a function of the level of oxidation.

9. The microfluidic pump as claimed in claim 1, wherein the metal of the plurality of metal electrodes comprises copper or aluminium.

10. The microfluidic pump of claim 1, wherein motion of the liquid droplet relies on a change in the oxidation state of the metal electrodes having direct contact with the liquid droplet.

11. A microfluidic pump comprising:

a channel having a plurality of metal electrodes which oxidise in air and a counter electrode;

wherein the oxidation state of the metal electrodes is controlled by changing the chemical nature of the surface of the metal electrodes in order to vary electrode wettability, wherein the counter electrode and the metal electrodes are spaced apart such that when a liquid droplet is in direct contact with at least one metal electrode of the plurality of metal electrodes and the counter electrode, the liquid droplet is moved by the microfluidic pump, wherein a surface of the counter electrode that is in direct contact with the liquid droplet is smaller in area than a surface of the least one metal electrode that is in direct contact with the liquid droplet such that change in the wettablity of the counter electrode does not prevent the liquid droplet motion, and wherein the counter electrode is formed at a side wall of the channel, with the metal electrodes formed at the base of the channel.

12. The microfluidic pump as claimed in claim 11, wherein the counter electrode is formed from the same metal as the metal electrodes.

13. The microfluidic pump as claimed in claim 11, wherein the liquid droplet is electrically conductive.

14. The microfluidic pump as claimed in claim 11, wherein the microfluidic pump comprises a circuit for applying a negative potential to the at least one metal electrode of the plurality of metal electrodes with respect to the counter electrode for controlling the oxidation state of the metal electrodes.

15. The microfluidic pump as claimed in claim 11, wherein the liquid comprises water.

16. A method of fabricating a microfluidic pump having a plurality of metal electrodes and a counter electrode, the method comprising:

forming a dielectric layer over a substrate;

forming a plurality of wells in the dielectric layer; and after the wells are formed, at least partially filling each well with a metal which oxidises in air to form the plurality of metal electrodes;

wherein when a liquid droplet is in direct contact with at least one metal electrode of the plurality of metal electrodes and the counter electrode, the liquid droplet is moved by the microfluidic pump, wherein a surface of the counter electrode that is in direct contact with the liquid droplet is smaller in area than a surface of the least one metal electrode that is in direct contact with the liquid droplet such that change in the wettablity of the counter electrode does not prevent the liquid droplet motion.

17. The method as claimed in claim 16, wherein forming a plurality of wells further comprises forming a channel.

18. The method as claimed in claim 16, wherein the metal of the plurality of metal electrodes comprises copper or aluminium.

19. The method as claimed in claim 16, further comprising forming an adhesion layer between the plurality of metal electrodes and the substrate.

20. The method as claimed in claim 19, wherein forming the adhesion layer between the plurality of metal electrodes and the substrate comprises forming the adhesion layer with Ta or TaN.

* * * * *